United States Patent [19]

Boon

[11] 4,393,961

[45] Jul. 19, 1983

[54] DEVICE FOR COUPLING PARTS OF A SELF-RAISING PLATFORM STRUCTURE

[75] Inventor: Bart Boon, Schiedam, Netherlands

[73] Assignee: RSV-Gusto Engineering B.V., Schiedam, Netherlands

[21] Appl. No.: 237,148

[22] PCT Filed: Jun. 17, 1980

[86] PCT No.: PCT/NL80/00022

§ 371 Date: Feb. 18, 1981

§ 102(e) Date: Feb. 18, 1981

[87] PCT Pub. No.: WO80/02853

PCT Pub. Date: Dec. 24, 1980

[51] Int. Cl.[3] ..... E02B 17/06

[52] U.S. Cl. ..... 188/67; 74/531; 254/106; 403/374; 403/377; 405/196; 187/87

[58] Field of Search ..... 188/67, 44, 45, 65.1, 188/65.3, 30, 61, 41, 42, 43; 405/196, 219, 221, 199; 403/374, 377; 74/531; 187/87, 88; 254/105, 106, 108

[56] References Cited

U.S. PATENT DOCUMENTS

| | | | |
|---|---|---|---|
| 1,031,470 | 7/1912 | Sanna | 187/87 |
| 1,336,170 | 4/1920 | Stroud | 187/87 |
| 2,839,164 | 6/1958 | Roussel | 188/67 |
| 3,597,016 | 8/1971 | Gachot et al. | 188/67 X |
| 3,948,483 | 4/1976 | Leaumont | 254/106 |
| 3,986,368 | 10/1976 | Levingston | 254/105 X |
| 4,002,038 | 1/1977 | Phares et al. | 405/199 |
| 4,109,975 | 8/1978 | Mattson | 254/108 X |
| 4,213,244 | 7/1980 | Bell et al. | 188/67 X |

*Primary Examiner*—Douglas C. Butler

[57] ABSTRACT

A device for coupling together two bodies in any position with respect to each other, which bodies are mounted for a linear displacement with respect to each other, in particular in a self-raising platform structure for coupling together the platform and a leg of the structure, the device comprising at least one pair of first pawls (3), each pawl of which is connected to one of the bodies for a pivotal movement and the contact parts thereof are shaped so that upon a pivotal movement of the pawls towards each other points of the contact parts approach each other, so that the relative movement between the bodies will be inhibited in one direction while being permitted in the other direction, at least one pair of second pawls (4) having the same construction as and spaced apart from the pair of first pawls being provided, which are mounted in such a manner that upon a pivotal movement thereof towards each other corresponding points of the contact parts of the second pawls will approach each other to inhibit relative movement in the other direction.

4 Claims, 3 Drawing Figures

DEVICE FOR COUPLING PARTS OF A SELF-RAISING PLATFORM STRUCTURE

The invention relates to a device for coupling together two bodies in any position with respect to each other, which bodies are mounted for a linear movement with respect to each other, in particular, in a self-raising platform structure, for coupling to each other the platform and a leg thereof.

In case of two bodies mounted for a linear displacement with respect to each other, like for instance a dredging vessel and a spud pole, it is often desired that said bodies can be coupled in any position with respect to each other.

In case of two bodies mounted for a linear movement with respect of each other by means of a system operating stepwise, for instance a hydraulic system, there is furthermore the problem that upon disengaging the system followed by a movement of the bodies, re-engaging the system will only be possible at certain points of the path of movement.

This problem is particularly acute in self-raising platform structures, wherein it will consequently not be well feasible to lower the legs of the platform freely into engagement with the sea bottom and then to re-engage the displacement system for raising the deck of the platform structure.

In such a platform structure up until now the legs are therefore lowered by means of a displacement system operated stepwise, in which, however, the problem arises that in passing from the floating condition to the supported condition of the platform the legs can come free from the bottom due to the action of the waves, whereupon the legs will again engage the bottom accompanied by an impact.

The object of the invention is to provide a device for coupling together two bodies in any position with respect to each other, which bodies are mounted for a linear displacement with respect to each other, said device being particularly suited for use in a self-raising platform structure so that it will be possible to lower the legs freely to the sea bottom and to engage the displacement system without the occurrence of impacts.

This object is attained by the device according to the invention which comprises at least one set of pawl means, each pawl of which is pivotally connected to one of said bodies and is provided with a part capable of contacting the other one of said bodies. The pawl means are arranged at least on both sides of said other body and the pivot points of said pawl means are disposed in a plane extending transversely to the direction of displacement. The pawl means are mounted for a pivotal movement and the contact parts thereof are shaped in such a manner that upon a pivotal movement of the pawl means towards each other in the direction of said one direction of relative linear displacement, corresponding points of the contact parts approach each other so that the relative movement between the bodies in this direction will be inhibited, while being allowed in the other direction. Means are provided for making said pawl means to pivot towards and/or apart from each other as well as clamping means on the one body, said clamping means being operable to be brought into clamping engagement with said other body so that the relative displacement of the bodies with respect to each other is inhibited in at least the other direction.

Preferably said clamping means are formed by at least a second set of pawl means having the same construction as said first set of pawl means, and being spaced apart from said first set of pawl means but which are mounted for a pivotal movement in such a manner that upon a pivotal movement thereof towards each other in the direction of the other direction of relative linear displacement, corresponding points of the contact parts of the pawl means will approach each other.

When applying the device according to the invention in a self-raising platform structure in which the one body is formed by the platform and the other body by a leg and when the clamping means or said second set of pawl means are brought into engagement with said leg, the displacement system can be disengaged from this leg, whereupon by releasing said clamping means or said set of pawl means from engagement with the leg this leg can be freely lowered to for instance the sea bottom, whereupon by bringing said first set of pawl means into engagement the platform is permitted to move freely upward though not downward along the leg resting on the bottom, due to the wave-action.

Advantageously the contact part of each pawl means is formed by a circumferential part of said pawl means varying in accordance with a change in the angular position of said pawl means, while upon a pivotal movement of said pawl means in the direction of the relative displacement to be inhibited, the distance between said circumferential part and the pivot point of said means increase.

In a simple embodiment each one of said sets of pawl means may comprise two pawl means mounted on opposite sides of a strip shaped element fastened to said other body. In that case the means for moving towards and/or apart from each other may be formed of a piston-cylinder assembly the cylinder of which is connected to the one and the piston of which is connected to the other pawl means at points near said contact parts.

The invention will now be elucidated further with reference to the drawings in which.

Figure 1:
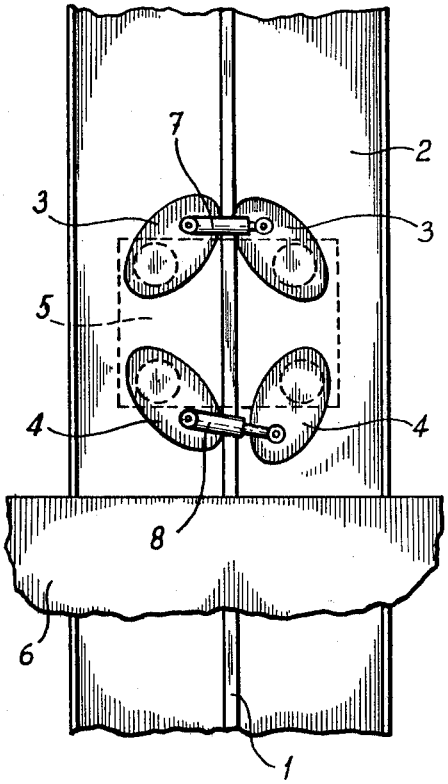
FIG. 1 shows a front elevation of a device according to the invention as applied in a self-raising platform structure.
Figure 2:
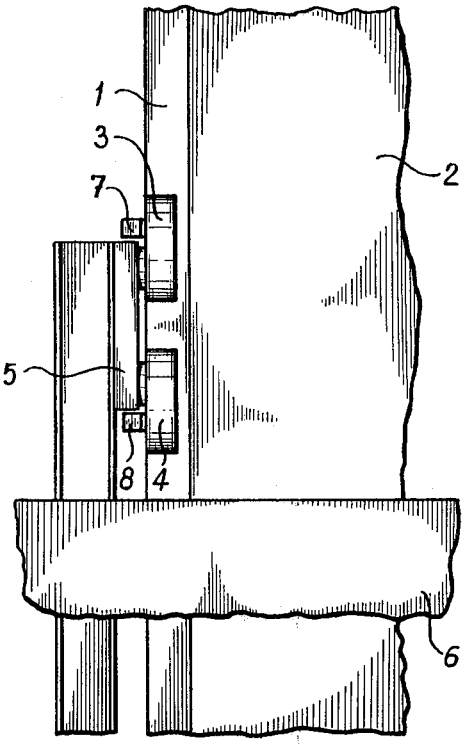
FIG. 2 shows the device according to FIG. 1 in side elevation.
Figure 3:
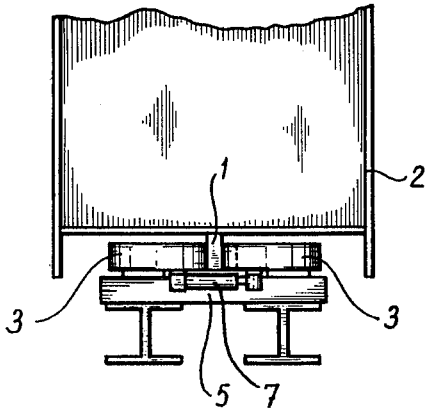
FIG. 3 shows said device in plan view.

As shown in the figures there is fastened a strip 1 to a leg 2 of a self-raising platform structure, said strip being parallel to the direction of relative displacement.

A first set of pawl means 4 and a second set of pawl means 3 are mounted for a pivotal movement to a yoke, said yoke 5 being fixedly mounted on the platform 6 of the structure. In the shown embodiment the pawl means 3, 4 are in the shape of an ellipse of which a circumferential part close to the one focus is capable of engaging the strip 1 so that when the pawl means 3 pivot towards each other in the direction of the one direction of relative displacement and when the pawl means 4 pivot towards each other in the other direction of relative displacement corresponding points of the contact parts of said pawl means approach each other.

The pawl means 3 are connected to each other by means of a piston-cylinder assembly 7, while the pawl means 4 are connected to each other by means of a piston-cylinder-assembly 8.

The self-raising platform structure is moved to its destination in floating condition in which the legs 2 are kept in the retracted condition by means of a hydraulic displacement system (not shown). When arrived at its destination the legs may optionally first be lowered over a predetermined distance by means of the displacement system whereupon the pawl means 3 are brought into engagement with the strip 1 so that the displacement system can be disengaged from said leg. By means of the piston-cylinder-assembly 7 the pawl means 3 can be disengaged from the strip 1 whereupon the leg 2 drops freely to, for instance, the sea bottom so that the platform 6 remains in floating condition. Thereupon the pawl means 4 are brought into engagement with the strip 1 by means of the piston-cylinder-assembly 8 so that the platform 6 due to the action of the waves may move freely upward along the leg 2 while it is prevented from moving downwardly when the platform 6 has reached its highest level in due course, said level being dependent on the highest wave movement, the displacement system may be re-engaged for raising the platform to a still higher level. In this way it is excluded that there will occur any impact between the legs of the platform structure and the bottom due to the wave-action.

I claim:

1. In a self-raising platform structure, a device for coupling together two bodies in any position with respect to each other, said bodies being mounted for linear displacement with respect to each other in two opposite directions, a platform forming one of said bodies and a leg of said platform structure forming the other body, said device comprising: at least one pair of pawl means, each pawl means having a pawl each pivotally connected at a pivot point to the same one of said bodies and provided with a part capable of contacting the other one of said bodies, said pawl means being arranged at least on both sides of said other body and the pivot points being disposed in a plane extending transversely to the direction of displacement, said contact parts being shaped in such a manner that upon a pivotal movement of the pawl means towards each other said contact parts approach each other, so that the relative movement between the bodies will be inhibited in one of said two directions while being permitted in the other direction, means for pivoting said pair of pawl means towards and apart from each other, and at least a second pair of pawl means connected to said one body and having the same construction as said first pair of pawl means, and being spaced apart from said first pair of pawl means but mounted in such a manner that upon a pivotal movement thereof towards each other the contact parts of the second pair of pawl means will approach each other so that relative movement between the bodies is inhibited in the other direction, and means for pivoting said second pair of pawl means towards and apart from each other.

2. A device according to claim 1, wherein the contact part of each pawl means is formed by a circumferential part thereof varying with a change in the angular position of said each pawl means while upon a pivotal movement of said each pawl means in the direction of the relative displacement to be inhibited the distance between said circumferential part and the pivot point of said each pawl means increases.

3. The device according to claim 1 or 2, wherein each set pair of pawl means comprises two pawl means located at opposite sides of a strip-shaped element connected to said other body.

4. The device according to claim 3, wherein said means for pivoting the pawl means towards and apart from each other are formed by a piston-cylinder assembly having a cylinder connected to one pawl means and a piston connected to said other pawl means at locations near to said contact parts.

* * * * *